United States Patent [19]

Weinhaus

[11] 4,287,676

[45] Sep. 8, 1981

[54] MAGNETICALLY SECURED DISPLAY APPARATUS

[76] Inventor: Robert S. Weinhaus, 868 Albey La., St. Louis County, Mo. 63132

[21] Appl. No.: 908,396

[22] Filed: May 22, 1978

[51] Int. Cl.[3] ..... G09F 3/18

[52] U.S. Cl. ..... 40/10 R; 40/600; 40/621; 248/206 A; 335/285; 335/303

[58] Field of Search ..... 40/158, 152.1, 600, 40/621; 248/201 A; 235/285, 303

[56] References Cited

U.S. PATENT DOCUMENTS

| | | | |
|---|---|---|---|
| 2,177,905 | 10/1939 | McKeehan | 40/621 X |
| 2,659,169 | 11/1953 | Brennan | 335/285 |
| 2,957,261 | 10/1960 | Moskowitz | 40/600 |
| 2,964,812 | 12/1960 | Cook | 40/621 X |
| 3,074,193 | 1/1963 | Munson | 40/600 |
| 3,150,296 | 9/1964 | McIntosh | 335/285 |
| 3,440,750 | 4/1969 | Toth et al. | 40/158 X |
| 3,518,884 | 7/1970 | Wood | 248/201 A |
| 3,670,435 | 6/1972 | Srewart | 40/621 X |

*Primary Examiner*—Gene Mancene
*Assistant Examiner*—Wenceslao J. Contreras
*Attorney, Agent, or Firm*—Neal Kalishman

[57] ABSTRACT

Display apparatus for magnetic securement to a smooth surface of a ferromagnetic or paramagnetic object comprises a support structure and a display surface carried by said support structure, the apparatus having a magnetic arrangement including a magnet carried by said support structure positioned for developing a force of magnetic attraction to said object with said display surface presented for display purposes. The apparatus includes a layer of elastomeric material associated with the magnet and adapted for being interposed between the magnet and the object surface with an area of the material maintained in contact with the surface by force of magnetic attraction. The material is selected from the group consisting of plasticized polyvinyl chloride, plasticized polyvinyl acetals, and vulcanizing silicone rubber. The area of such material in contact with the object surface develops high intrinsic lateral adherence to such surface for preventing the apparatus from moving laterally across the surface in response to high forces tending to laterally displace the apparatus. The apparatus, accordingly, makes synergistic use of both magnetic forces and peculiar characteristics of the elastomeric material to achieve unexpectedly high lateral adherence.

25 Claims, 16 Drawing Figures

PRIOR ART

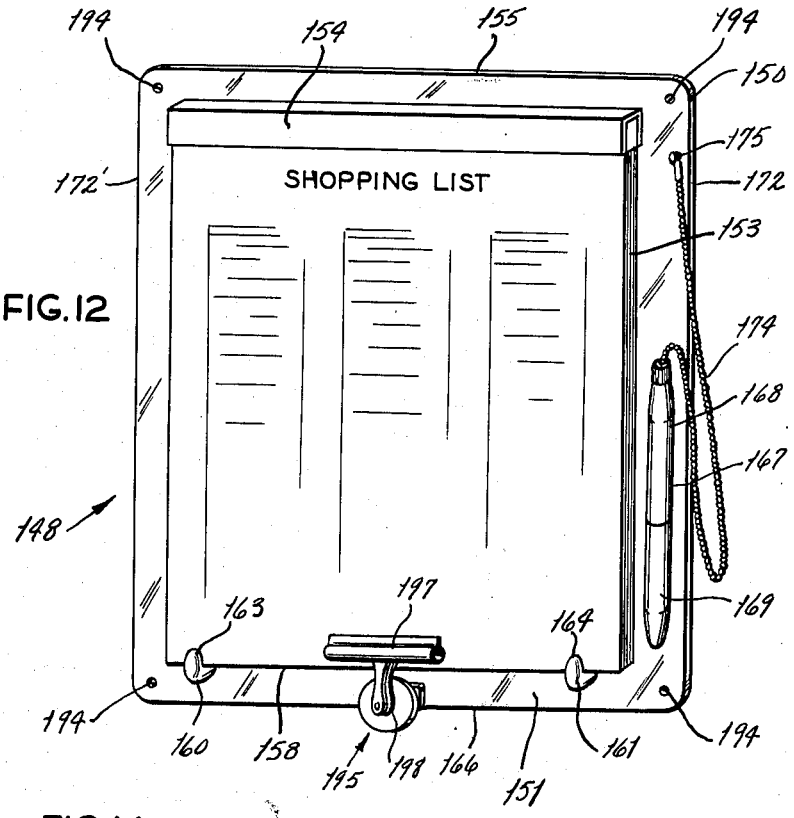
FIG. 12
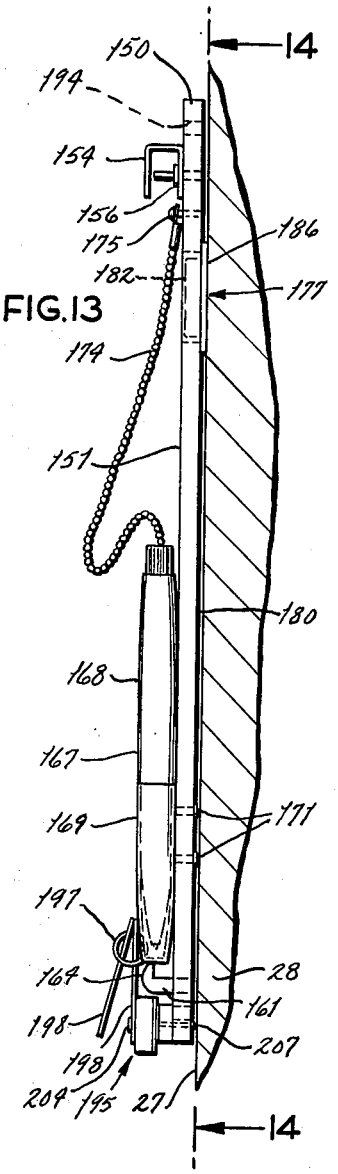
FIG. 13
FIG. 14
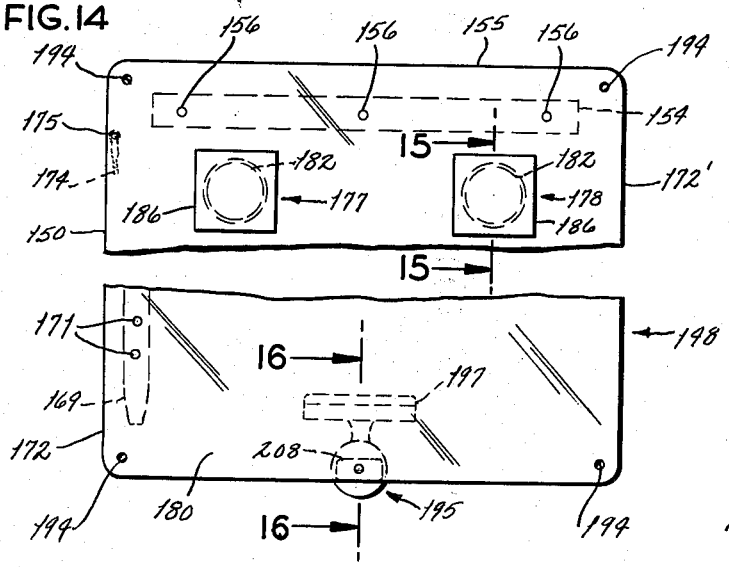
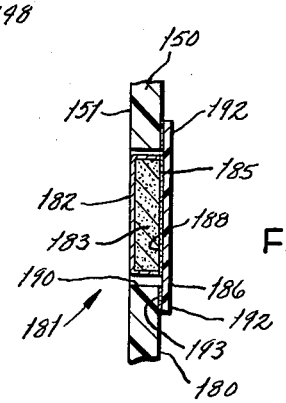
FIG. 15
FIG. 16
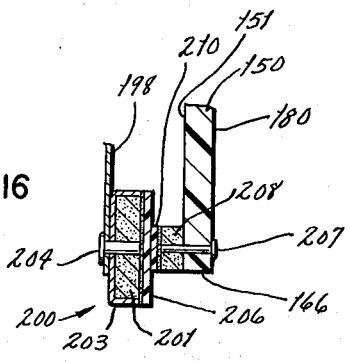

MAGNETICALLY SECURED DISPLAY APPARATUS

BACKGROUND OF THE INVENTION

The invention relates to apparatus for magnetically securing one object to another and, more particularly, to an apparatus intended for magnetic securement to an object and having extremely high intrinsic lateral adherence thereto.

It has hitherto not been known to make effective economical use of relatively low power magnets for the purpose of securing relatively heavy objects against steel or other ferromagnetic, or paramagnetic, surfaces so as effectively to resist lateral movement across such surfaces. To preclude apparatus from being moved laterally across the surface, it has been conventional to employ relatively high magnetic forces or to use the combination of magnetic forces and permanent adhesives in combination to effect a non-releasable adherence of one object to another.

It is a common procedure to utilize small permanent magnets for the securement of paper or the like to steel surfaces. Yet, it has not been practical to magnetically secure a heavy display board or the like to a steel or other ferromagnetic or paramagnetic surface because of the expense, weight and sheer bulk of permanent magnets required to develop sufficient forces of magnetic attraction to cause an item to be maintained in position by the magnet, to remain in position on such surface even though there may be high forces tending to laterally displace the same.

While it is, of course, an old and well known expedient to secure a magnet to an object for the purpose of attaching that object to another object, it is, however, almost invariably characteristic of small permanent magnets which typically are of such materials as plastic, ceramic, or alloyed metals (e.g. alnico), that the magnet material characteristically is so hard or slippery that the ratio of a force necessary to displace the magnet laterally across a surface, such as smooth enameled or polished steel or other ferromagnetic material, is typically so low in relationship to the pull force of the magnet as to effectively preclude the application of a usefully high lateral force to the magnet. Typically, the lateral force required to displace a low power magnet from a surface to which it is magnetically attached, is far less than the magnetic pull force. For example, for most small or low power plastic, ceramic or metallic magnets of relatively low power which are commercially obtainable, the displacement force may typically be only 20% to 30% of the pull force of the magnet.

In other words, such plastic, polymer based ceramic or metal magnets of the type noted usually can be displaced by relatively small forces tangential to the surface (i.e., displacement force) upon which they are applied when that surface is a typically smooth one such as bare, painted, enameled or other treated metal.

Although it is possible, of course, to provide magnets and the surfaces to which they are to be attached with interlocking grooves or the like, or to provide a permanent adhesive between the magnet and surface as disclosed in Fayling U.S. Pat. No. 3,897,288, more frequently such expedients are undesirable or impossible and it is instead desired to effect adhesion of a magnetic apparatus to a ferrous metal surface or to any other object having a ferromagnetic or paramagnetic material by the use of a magnet of sufficient strength to cause the magnet to adhere to the surface by the simple expedient of static friction. The prior art is replete with numerous structures and apparatus having magnets which are applied directly to the surface to which the magnet will provide magnetic attraction.

On the other hand, it has been known to imbed or recess magnets within a non-magnetic material of a resilient nature, such as rubber, for the purpose of causing the material to contact the surface to which the magnets are attracted. Such structures are taught, for example, in U.S. Pat. Nos. 2,621,661; 2,666,352; and 2,709,245. In each of these patents, a relatively small, light article is adapted for being secured to a ferrous metal surface by a magnet which is positioned in rubber material so that only rubber is in contact with the ferrous surface. While magnets can be employed in this fashion to provide sufficient forces of magnetic attraction and adhesion to a surface to which the magnet is attracted to cause the article to remain in position if it is of sufficiently light weight, as a practical matter, such structures of magnets imbedded in rubber or similar materials do not provide sufficiently high intrinsic lateral adherence to the surface to which the magnet is attracted if the article has a weight which begins to approach the bare pull force of the magnet.

It has been known to concurrently apply magnetic forces and adhesive forces to fasten articles together. A method of doing so is disclosed in Fayling U.S. Pat. No. 3,897,288 wherein layers of reactive adhesive are carried on exterior bonding faces of a magnetized polymer-based article. The polymer-based magnet is placed between adjacent articles during a fastening operation to apply a magnetic force tending to draw the articles together and to apply pressure on the adhesive material disposed between the articles. Hence, the magnetic forces between the articles tend to cause the structure to be stably maintained until the adhesive can be set. However, the method disclosed in said Fayling patent precludes removing a magnetically secured article after the adhesive has become set. Hence, the arrangement is not releasably adhesive as is desired in many situations in which an article to be magnetically secured to a surface so that the article can be readily removed and relocated to another position on the surface. There are numerous other teachings in the prior art of arrangement in which magnetic structures are permanently adhered by a non-releasable adhesive to a surface. For example, such arrangements are disclosed in U.S. Pat. Nos. 3,195,022 and 3,365,684.

A need which is frequently encountered domestically illustrates the desirability of providing a display structure which is removably secured to a surface and yet may stably be maintained on such surface by forces of magnetic attraction. In many busy households, particularly with families having children, it is common practice to secure various sheets of paper, loose leaves, clippings, coupons, memos and shopping lists to the front of a refrigerator or other ferrous metal appliance by the use of small permanent magnets. Such an arrangement is not only unsightly but remarkably ineffective since the magnets typically will not support much weight. It is, therefore, nut uncommon for such items to slide down or fall off the front face of the appliance. In addition, such arrangements do not permit the magnetic securement of a pad of memos or shopping lists to the front face of the appliance since such pads are too heavy to be supported by small permanent magnets.

Accordingly, there is a need for a display device which can be magnetically secured to the upright surface of a refrigerator or similar appliance which is capable of supporting a pad or numerous sheets of such items as sheets of paper, clippings, coupons, memos or shopping lists. Of course, sufficient hang force for supporting noteboards, memo pad holders, and the like, may be obtained by using strong, metal button magnets or large surfaced plastic flexible magnetic sheets or strips where such magnets are applied directly to the surface of the appliance. In such case, the static friction which is sufficient to prevent such apparatus from being displaced laterally on the surface, such as by force of gravity, will, in any event, be provided by the rough metal surface irregularities of such magnet which dig into the ferrous metal face, or painted or other treated surface, of the appliance. This result is totally unacceptable since the surface will be scratched upon not only any application of the magnet but any sliding thereof. In any event, such strong, metal button magnets are relatively expensive.

Various attempts have been made in the past to overcome the problem of applying magnets directly to ferrous or painted ferrous metal surfaces. For example, Rice U.S. Pat. No. 3,230,653 discloses a license plate holder having a bracket to which are secured flat elongated magnetic members which are constructed of flexible resilient permanent magnetic material. Of course, such material is well known in the market place but typically is incapable of providing high static friction to the surface to which it is applied and, hence, is most readily displaced laterally by gravity or other forces acting tangentially to the surface to which the magnet is secured.

Similarly, Podoloff U.S. Pat. No. 3,245,165 discloses an arrangement for mounting signs or the like to a ferrous support, such as on the side of a vehicle. For this purpose, there is disclosed in the latter patent a device comprising an annular magnet which is retained by a resilient rubber sleeve of annular shape. The sleeve extends under the magnet so as to provide a surface for bearing against the ferrous metal support to which the magnet provides a magnetic attraction. This precludes marring of the surface. However, it has been found that rubber of such character does not provide sufficient intrinsically high lateral adherence to the surface to support heavy weights unless extremely high power, expensive magnets are utilized.

Moskowitz U.S. Pat. No 3,082,982 also discloses an arrangement in which magnets are utilized to maintain a staff support or the like on the top surface of a vehicle, for example. The arrangement disclosed therein includes a magnet having pole pieces which extend from the structure of the staff support and, to preclude scuffing of the top of the vehicle. The pole pieces are coated with a protective plastic coating. The structure is intended to provide a relatively high co-efficient of friction between the pole pieces and the vehicle body. However, the apparatus disclosed in said Moskowitz Patent is not suited for securement of a memoboard, noteboard, or the like to the vertical, or upright, surface of an appliance and is not such as to provide sufficient lateral adherence to such an upright surface to preclude lateral displacement of the same in response to high forces, such as the gravity acting on the heavy device, which tend to displace the same.

As a matter of generality, magnetic display boards for use in places such as kitchens, on the front or other surfaces of refrigerators, appliances, or cabinets of sheet steel or other ferrous metal, which usually are covered with enamel but are sometimes of a stainless steel construction, and steel cabinets, such as file cabinets or the like in offices, have hitherto not been widely used to hold significant weights. Chiefly, the problems with such prior devices are that they are either too costly to manufacture because of the powerful magnets required and the requisite methods of constructing the same to incorporate such magnets, or have been too lacking in "hang force" to accommodate the holding of significant weights, such as a pad of paper, memos, shopping lists or the like where such pad is more than a few square inches in area and is of useful thickness.

In the case of appliances, the front surface of the same often is typically not a plane surface, but instead it is often slightly curved about a vertical axis or may be, in fact, a convex surface or irregular surface. Consequently, the securement of a display device to such surface presents the problem that, if the magnets affixing the same to such surface cannot be adjusted, they will tend to be held out away from the surface except at one point of contact or, at best, one line of contact. Only magnets at that point of contact, or along such line of contact, will provide effective forces of magnetic attraction to such surface since, as is known, the attractive forces of a magnet to such surface fall off abruptly with any spacing of the magnet from the surface. Consequently, if the magnet is not close to the surface its attractive power is greatly diminished. This can be overcome by an adjusting mechanism for enabling each of a plurality of magnets of such a device to contact such surface, but any adjusting mechanism desirably must avoid adding any excessive weight to the device and should not unnecessarily increase the distance of the device from the surface to which it is to be magnetically secured in order to preclude undesirable displacement of the center of gravity and, therefore, undesirable leverage of such device away from the surface to which it is to be secured, to prevent "peeling away".

In this regard, it is desirable that the center of gravity of the display apparatus affixed by magnets to an adjacent surface be placed as close as possible to the surface. As the center of gravity is displaced further outward from the surface to which the apparatus is secured, a greater moment of force is created by gravity which moment tends to detach the apparatus from such surface.

Consequently, a memo board for magnetic securement to a vertical surface must desirably overcome these difficulties if it is to remain in place for serving its intended purpose. Additionally, however, such display apparatus must have a sufficient margin of weight-carrying ability that it will remain in place even though jarred, shaken, jolted or otherwise disturbed so as to avoid the possibility of becoming dislodged and thus falling with a danger of injury to a person such as a young child opening or closing a refrigerator door to which the apparatus is attached.

SUMMARY OF THE INVENTION

A primary object of the invention is the provision of an apparatus for magnetic securement to a surface which is highly laterally adherent to said surface, a related object being the provision of such apparatus which upon application to a smooth surface is capable of remaining in position on said surface in resistance to high lateral forces applied to said apparatus.

A further object is the provision of such apparatus which is capable of remaining in position on a surface to which it is secured by forces of magnetic attraction in resistance to lateral forces which are much greater than the forces of magnetic attraction which secure the apparatus to such surface.

Yet another object of the invention is the provision of such apparatus which permits of magnetic securement to a surface which is vertical, or upright, and exhibits a degree of lateral adherence to such surface, or so-called "hang force," which is much greater than the weight of the apparatus.

Among further objects of the invention may be noted the provision of such apparatus which is adapted for being magnetically secured to a surface but which is readily removable from such surface; the provision of such apparatus which when applied to a surface does not scratch or mar the same and, accordingly, which may be selectively removed or reapplied, or repositioned on such surface without causing damage thereto; the provision of such apparatus which develops high magnetic forces of attraction to a surface to which it is applied through the use of relatively low cost, low power magnets, such as inexpensively commercially available permanent magnets; and the provision of such apparatus which provides for contacting of the surface to which it is magnetically secured by an elastomeric material but where such material displaces the magnet from such surface so little that it does not excessively reduce the attractive forces available by such magnet.

An important further object of the invention is the provision of a display apparatus for display or other purposes which is extremely well suited for magnetic securement to the upright front or other surfaces of refrigerators, appliances, kitchen, filing and other cabinets, walls and partitions, vehicles and other objects of magnetic, ferromagnetic or paramagnetic materials, such as to the front side or other surfaces of such refrigerators, applicances, etc.

A further object of the invention is the provision of such a display apparatus which is capable of carrying a relatively heavy pad of memos, shopping lists, or the like, such apparatus being amenable to the carrying of relatively heavy and large pads in safe, secure, and lateral displacement-resistive relationship to such surface, and particularly such display apparatus having a display surface which typically is flat and firm enough so that it serves as a suitable base for writing on the pad, memo, etc.

An important further object of the invention is the provision of apparatus not limited to display purposes but suitable for the magnetic securement of various objects, masses, and items amenable to suspension, for example, boat hangers, pegboards, pictures, charts, maps, moveable markers and the like. The invention may also magnetically secure signs, lists, order blanks, shopping lists, list of contents, pictures, maps, flow and other charts, etc.

Another object of the invention is the provision of such display apparatus which is accommodative of curvatures, convex configurations, or other irregularities of the surface to which the apparatus is magnetically secured, and which apparatus maintains fast, secure, and lateral displacement-resistive relationship to such surface notwithstanding such curvatures, convexities or irregularities. A related object of the invention is the provision of such display apparatus which provides for extremely close placement of the center of gravity of such apparatus to such surface to which it is magnetically secured so as to prevent the center of gravity from exerting excessive force of leverage as would tend to displace or pull the apparatus from such surface.

Yet another object of the invention is the provision of such display apparatus which provides for the securement of pads of memos, shopping lists, or the like in a most convenient, usable and efficacious manner. Among other objects of the invention may be noted the provision of such display apparatus which provides for the orderly and convenient securement of loose leaves, clippings, coupons, or the like.

A further object of the invention is the provision of such apparatus which is of extremely economical construction and permits the use of extremely low cost, inexpensive magnets, yet provides such high lateral displacement-resistive relationship to such surface and such high magnetic forces of attraction thereto as to effectively preclude falling or displacement from an upright surface in normal usage and which is, therefore, extremely safe and effective in use so as to preclude falling from a refrigerator, appliance, or other location on an upright surface in domestic use in an unsafe manner.

Briefly, the present disclosure contemplates the provision of apparatus for magnetic securement to an object having a smooth surface, such as surfaces of refrigerators, appliances, cabinets, or other ferromagnetic or paramagnetic material, which surfaces may be of polished metal, anodized, plated, painted, enameled, or otherwise coated or treated. The apparatus provides lateral displacement-resistive relationship to such surface. For this purpose, the apparatus includes an elastomeric material and at least one magnet adapted to maintain said elastomeric material in contact with said surface by a predetermined force of magnetic attraction normal to the surface. Such elastomeric material has sufficiently high intrinsic lateral adherence to be maintained in fixed position on said surface in resistance to lateral forces applied thereto and to remain on such surface until said lateral force reaches a maximum value which is much greater than the force of magnetic attraction.

Typically, the apparatus is capable of sustaining maximum lateral forces, before being displaced, which range in the value of about 2 to about 8 times the force of magnetic attraction. The preferred elastomeric material is selected from the group consisting of plasticized polyvinyl chloride, plasticized polyvinyl acetals, and vulcanizing silicone rubber.

A specific embodiment of the invention is presented in the form of a display apparatus having a relatively thin sheet of material which is magnetically secured to such a surface in lateral displacement-resistive relationship thereto, such sheet of material supporting a relatively large pad of sheets of memos, shopping lists or the like. In such embodiment, a layer of elastomeric material is interposed between permanent magnets and the surface to which the magnets are capable of providing a force of magnetic attraction, with an area of said material being maintained in contact with said surface by such force of magnetic attraction. The magnets and elastomeric material associated with them are carried by the apparatus in such fashion as to be accommodative of curvatures and irregularities of a surface to which the apparatus is intended to be secured. For this purpose, the magnets are supported for movement such as to provide conformal adherence to said surface.

Other objects and features will be in part apparent and in part pointed out below.

BRIEF DESCRIPTION OF THE DRAWINGS

FIG. 12 is a perspective view of a display board of the present invention adapted for magnetic securement to a surface of ferromagnetic or paramagnetic material.

FIG. 13 is a cross section of the display board of FIG. 12.

FIG. 14 is a rear elevation, partly broken away, illustrating magnet assemblies utilized in the display board of FIG. 12.

FIG. 15 is a cross section of a permanent magnet assembly utilized in the display board of FIG. 12.

FIG. 16 is a cross section of a clip assembly which is magnetically retained on the display board of FIG. 12 in accordance with the invention.

Corresponding reference characters indicate corresponding parts throughout the several figures of the drawings.

DESCRIPTION OF THE PREFERRED EMBODIMENTS

Figure 1:
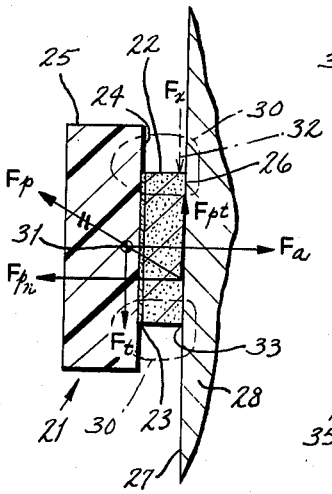
FIG. 1 is a cross section of an assembly of a device having a permanent magnet attached thereto which is illustrative of a prior art configuration.

Referring now to the drawings, FIG. 1 illustrates a permanent magnet assembly of a type which has been known heretofore. Such assembly, which is designated generally at 21, includes a permanent magnet 22 which is adhesively secured at 23 to the face 24 of an object 25. The permanent magnet 22 of such a prior art assembly may instead be secured by screws or other fasteners.

However, it is sufficient to note that such assembly 21 is typical of many known configurations in which any of various objects such as that designated at 25 may be magnetically secured by a magnet carried by the object to a smooth surface of a ferrous, e.g. ferromagnetic or paramagnetic or magnetic material by direct appication of a bare face 26 of the magnet to such surface. A section of such a smooth surface is designated at 27, and is, of course, of a material 28 of such character as to be capable of being attracted to the magnet 22, although the metal surface 27 may be painted or provided with a coating. Examples of such material 28 typically encountered are iron and various steels which are, generically, ferromagnetic.

Ferromagnetic materials may be characterized as having a large (much greater than unity) relative permeability $\mu/\mu_o$ where $\mu$ is the permeability relating the flux density $\beta$ of the material to magnitizing force H in a nonlinear relationship and where $\mu_o$ is the permeability of free space and approximately also that of air.

Ferromagnetic materials also have a high maximum intrinsic flux density $\beta_{max}$. They are also readily magnetized, retaining magnetization when magnetizing force is removed.

Paramagnetic substances, by comparison, have a rather small (but greater than unity) relative permeability and lose all their magnetism when an external magnetic field is removed. However, like ferromagnetic materials, paramagnetic materials may be expected to be attracted to a permanent magnet or other magnetic device capable of applying an external magnetic field thereto in such a way that there is a magnet-induced flux passing through the paramagnetic material to create a magnetic circuit therethrough.

As is well known, permanent magnets and electromagnets are readily configured, often in conjunction with ferromagnetic structures such as steel, iron or alloy pole pieces, for being placed against the surfaces of ferromagnetic (or paramagnetic) objects in such a way that a magnetic circuit is created having small or minimal air gaps in the circuit so that a force of magnetic attraction is developed between the magnetic structure (whether of an electromagnet or permanent magnet type) and such an object by virtue of the energy stored in the magnetic circuit. For small air gaps in a magnetic circuit, a force of attraction between the adjacent forces of an air gap can be approximated as $f=0.0139\ \beta_a^2 A$ where f is the force in pounds, $\beta_a$ is the flux density in the gap in kilolines ($10^3$ maxwells) per square inch, and A is the cross-sectional area of the gap in square inches.

This approximation assumes that the flux density across the gap is uniform. As the gap increases, fringing must be taken into account. Of course, as is known, such fringing results in a marked reduction of the magnetic force of attraction across a gap as the gap spacing increases, inasmuch as the flux density is greatly decreased and the force varies as the square of the flux density.

Various electromagnet and permanent magnet pole and placement configurations are well known, including the use of polymer based permanent magnets comprising flexible sheet material filled with magnetized particles, e.g., barium iron oxides, which provide numerous small adjacent areas which are oppositely polarized so as to provide mutual forces of magnetic attraction when placed adjacent a surface of a ferromagnetic or paramagnetic material.

For present purposes, magnet 22 may be assumed to be of a small disc configuration so as to provide typical magnetic lines of flux as indicated in phantom at 30. Surface 28 may represent by way of example, but not of restriction, the front of a regrigerator or a similar domestic appliance, or conceivably a cabinet, or a slanted or horizontal worktable top said material 28 being then conventionally of sheet steel or other materials of the types previously identified.

The assembly 21 has a composite center of gravity 31 through which the net weights of object 25 and magnet 22 act to provide a gravitational or other lateral displacement force $F_t$ which is tangential to surface 27 tending to displace assembly 21 laterally (i.e., downward, in this illustration) relative to surface 27. The magnetic circuit established by magnet 22 and material 28 provides a force of magnetic attraction $F_a$ which is normal to surface 27 and a corresponding force $F_p$ is exerted by surface 27 against magnet 22 if assembly 21 remains at rest, with said force $F_p$ inclined as indicated since assembly 21 is in equilibrium.

The force $F_p$ may be resolved into a frictional force $F_{pt}$ which is tangential to surface 27 and a component $F_{pn}$ which is normal to surface 27. As will be apparent, the force $F_t$ tending to displace assembly 21 can be increased until a limiting, or maximum displacement, force value is reached at which assembly 21 will slip on surface 27. At this maximum value $F_t'$, a maximum frictional component $F_{pt}'$ will be attained which is nearly proportional to the magnetic attraction force $F_a$ which is available. A relation $F_{pt}'=KF_a$ exists in which K is effectively a coefficient of static friction.

If an additional weight or force $F_x$ is hung from or exerted laterally against assembly 21 which, for purposes of illustration only, may be assumed to act through center of gravity 31, assembly 21 will remain immobile on surface 27 until $F_x+F_t=F_{pt}'$. Accordingly, by substituting for the expression of $F_{pt}'$ in terms of the coefficient of static friction K, it is seen that assembly 21 can support additional weight or resist additional lateral force $F_x$ until $F_x=KF_a-F_t'$ at which point static friction ("stiction") is overcome and assembly 21 begins to slip laterally relative to surface 27. In this case, such lateral slippage will be downward in the case of gravity, and it may be assumed that the assembly 21 will no longer serve its intended purpose. Of course, for vector forces applied other than vertically, such slippage would be in the direction of the applied force when such force increases the static friction. The additional capability of a magnetic assembly such as 21 to support weight or resist lateral force may then be measured in terms of a maximum hang force $F_x$.

With conventional magnetic structures employing any of the various known types of permanent magnets, such as metallic, ceramic, plastic, and polymer-base types, and in any of the typically available configurations, such as cylindrical, annular, rectangular, etc., it is found that the hang force $F_x$ is usually less than, and typically much less than, the force of magnetic attraction $F_a$.

As a practical matter, it is found convenient to simply compare the hang force $F_x$ and attractive force $F_a$ in terms of a ratio $F_x/F_a$ as a figure of merit of the "hang capability" of a magnetic structure such as assembly 21. Further simplification of the evaluation of such structures, for testing purposes, may be obtained by applying the additional hang force $F_x$ tangential to surface 27 to the structure under evaluation at a point close to the surface 27, such as indicated at 32. This avoids or substantially minimizes any bending moment which otherwise results about the lowermost point of contact 33 of the structure with surface 27.

It is usually not practical to apply such hang force $F_x$ to a structure precisely at its point of contact with surface 27; it has been found convenient to apply a test force at a short distance from surface 27 such as at about 0.25 in. outward therefrom by using an appropriate test jig.

When evaluated in this fashion, conventional magnetic structures have been found to provide ratios of $F_x/F_a$ varying from about 0.17 to about 1.3, and typically less than unity.

Such ratios are found by direct application of the external vertical force $F_x$ directly to the magnet without an object 25 secured thereto, in order to eliminate the effects of loading or otherwise effecting lateral adhesion of the conventional magnet structure by the weight or moment of such object.

As will be apparent, the maximum lateral displacement force $F_x$ which can be applied to structure 21 before lateral displacement occurs may be increased if the structure is magnetically secured to a horizontal surface which faces up, since the force of gravity in the structure then acts in the same direction as the magnetic attraction force $F_a$.

Figure 2:
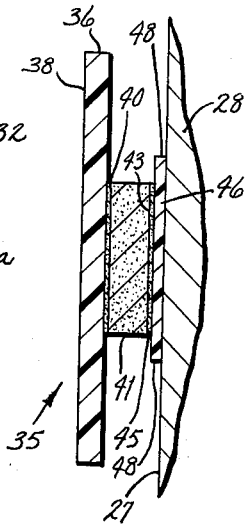
PRIOR ART FIG. 2
FIGS. 2–4 are cross sections of assemblies of the present invention for magnetic securement to an object having a smooth surface in lateral displacement-resistive relationship to such surface, illustrating three alternative permanent magnet configurations.

In accordance with the invention, FIG. 2 illustrates an apparatus generally designated at 35 having a sheet 36 of relatively thin, flat material, such as, by way of example not by way of restriction, acrylics or other suitable plastics or woods, composition board, non-ferrous, ferromagnetic and paramagnetic metals, or various other materials suitable for providing a surface 38 for display or other purposes, the general shape of said sheet 36 in plan being immaterial but, in any event, suitable for the purposes intended. Said sheet 36 is secured by a layer of adhesive 40 or by other fastening to a permanent magnet 41. Alternatively, fastening may be effected by use of at least one fastening device, such as, by way of example but not by way of limitation, stud, rivet, hook, hinge, or screw, etc. Permanent magnet 41 may be of any of the conventionally shaped small permanent magnets which are typically commercially available, such as one of the various types noted above. It may, for example, be constituted by a small cylindrical magnet of ceramic, metal or plastic construction, but oriented, in any event, so that it presents a face 43 (which may be circular, rectangular, annular, or the like) oriented toward the smooth coated or uncoated surface 27 of the ferromagnetic or paramagnetic material 28 previously described.

Secured by an adhesive layer 45 to said face 43 of the magnet is a thin layer 46 of elastomeric material. Such material is adapted to provide high intrinsic lateral adherence to said surface 27 when maintained in contact with said surface by a force of magnetic attraction developed mutually between magnet 41 and material 28 as previously described.

Preferably, though not necessarily, a marginal portion 48 of said sheet material 46 extends outwardly beyond the periphery of magnet 41 so as to provide additional area which, because of the tendency of the material to remain flat, will tend also to be maintained against said surface 27 for enhancing lateral adhesion thereto. The shape of layer material 46 in plan is not critical and may satisfactorily be circular, rectangular, or of various other shapes, but will preferably correspond with the general plan shape of magnet 41.

The type of adhesive provided at 40 and 45 for securing the assembly 35 together is not critical and, in various types of commercially available cements of a permanent nature, which may be flexible or inflexible, satisfactorily may be employed so long as they are capable of providing permanent adhesion between the constituent elements of the assembly. Some elastomeric materials can be self-adhered to the magnet by physical or chemical means.

The layer 46 of elastomeric material may have a thickness which, in a broadly preferred range, may vary from about 0.5 to about 60 mils. Such thicknesses have been found to provide useful results when employing various kinds of magnets of the foregoing type having magnetic pull forces, i.e., attraction, when applied bare, i.e., without an interposed layer, to a ferromagnetic surface, ranging from about 0.5 pounds to about 4.0 pounds.

Materials which have been found suitable for said elastomeric layer 46 are those which are selected from the group consisting of plasticized polyvinyl chloride, plasticized polyvinyl acetals, and vulcanizing silicone rubber.

In devices in which the layer 46 of elastomeric materials which is applied against surface 27 is plasticized polyvinyl chloride, it has been found especially efficacious to employ a fabric-backed calendered polyvinyl chloride sheet material having a calendered surface and a fabric surface, the calendered surface being presented for contacting surface 27 and the fabric surface being adhesively secured, as indicated at 45, to the face of magnet 41 which is oriented toward surface 27. Hence, the calendered surface is presented for contacting the surface 27 of any object to which the apparatus 35 is to be magnetically secured.

A remarkably efficacious form of such material is that constituted by sheet material comprising cotton sheeting-backed polyvinyl chloride having a total thickness of approximately from 22 to 25 mils and sold by the General Tire & Rubber Company, Toledo, Ohio, under the trade designation "TOLEX PATENEL 30219". Such material has a weight of about 19.3 to 21.3 ounces per square yard and high tensile and tear strengths. Such material also has a mirror-like shiny surface resulting from the calendering of the polyvinyl chloride face; although the material is of a highly flexible nature, it provides substantial strength. The fabric backing is particularly suitable for adhesive securement to a face of the magnet 41 as illustrated.

When the elastomeric layer 48 is of plasticized polyvinyl acetals, it is preferred to utilize a plasticized polyvinyl acetal constituted by polyvinyl butyral in the form of a sheet of such material having a thickness of from about 10 to about 60 mils generally and, more preferably, having a thickness of between about 15 to about 30 mils.

A preferred form of such material is that commercially available from Monsanto Company, St. Louis, Mo., and sold under the trademark SAFLEX ®SR. The latter material is a polyvinyl butyral resin suitably plasticized e.g., by the addition of a suitable amount of triethylene glycol di (2-ethyl butyrate), for example. However, other polyvinyl acetal resins may be employed such as made from various unsubstituted ketones containing an active carbonyl group or from mixtures of unsubstituted aldehydes and ketones. Suitable for the present purposes are polyvinyl acetal resins made from unsubstituted saturated aliphatic aldehydes such as propionaldehyde and valeraldehyde—and especially those made from formaldehyde, acetaldehyde, butyraldehyde, and mixtures thereof.

Polyvinyl butyral resin as described above is made from butyraldehyde which is plasticized to the extent of about 20 to 60 parts plasticizer per 100 parts resin and preferably between 40 and 50 parts plasticizer per 100 parts resin. Suitable plasticizers are esters of a polybasic acid or a polyhydric alcohol among which are included the previously noted triethylene glycol di (2-ethyl butyrate).

Such plasticized polyvinyl butyral resin inner layer is self-adhesive in nature, when suitably applied, so as to eliminate the need for a separate adhesive 45 between the magnet 41 and elastomeric layer 46. For this purpose, the polyvinyl butyral resin layer may be autoclaved or suitably heated to the point of extreme tackiness so that, when applied to the face 43 of magnet 41, it will cool and remain substantially permanently adherent to the face of the magnet.

Alternatively, various solvents may be utilized for softening a shallow region in the face of layer 46 which opposes face 43 of the magnet and thus is affixed after such softening of the material with the solvent. For this purpose, suitable solvents include acetone, diacetone alcohol, ethanol, ethylene chloride, isopropanol, methyl acetate, and possibly methanol as well as various other well known solvents, such as possibly methylethyl ketone and toluene.

Notwithstanding the method of adhesion of said polyvinyl butyral resin, it is preferably nonreleasably adhesively secured to the face of the magnet body which is opposed to surface 27.

The polyvinyl butyral resin sold under the above-noted trademark is a tough, resilient film which has been utilized heretofore as an interlayer for laminated glass for windshield applications and its preparation for such use is described in Mont et al U.S. Pat. No. 3,249,488.

If the layer 46 of elastomeric material is of vulcanizing silicone rubber, it is preferred to use a commercially available silicone rubber in the form of silicone rubber sealant of the type which vulcanizes or cures at room temperature, such as that sold under the trademark SILASTIC ® 732 RTV or under the trademark DOW CORNING ® SILICONE RUBBER SEALANT or SILICONE RUBBER BATHTUB CAULK. Such material cures to a tough, rubbery solid when exposed to moisture in the air. It is preferred to apply such material in such manner as to create a layer 46 having a thickness of broadly between 0.5 and 60 mils and, more preferably, from about 10 to about 25 mils. A silicone rubber of such type as above noted is self-adhering to the face 43 of magnet 41, if applied thereto in an uncured state, and hence, obviates the need for a separate adhesive layer 45.

Although there are many silicone elastomers which conceivably may be utilized to provide the requisite inherent lateral adherence of the elastomeric layer 46 which is in accordance with the invention, the above noted material is found to provide a superior result. Silicone elastomers may be prepared from a mixture of dimethyl silicone polymer, an inorganic filler, and a vulcanizing agent, the silicone polymer being preferably made by polymerization of very pure difunctional silicones in order to obtain a high molecular weight. Silicone elastomers show properties of stretch and retraction, bounce, and great flexibility which characteristics are maintained over a substantial temperature range.

For the purposes of applying such material to the face 43 of the magnet which is oriented toward surface 27 in the form of a layer having substantially uniform thickness, it is preferred simply to extrude from the shipment container a quantity of the silicone rubber sealant material onto face 43 of the magnet and then to apply to the as yet uncured silicone rubber material a sheet of "MYLAR" flat sheet material which, as is known, is an extruded polyester such as made from poly(ethylene terephthalate). Such extruded sheeting is nonadherent to the silicone rubber material upon curing of the latter and hence may be utilized to form a flat surface of the silicone rubber material to create layer 46 having desired thickness. In utilizing such "MYLAR" sheeting material, a structure 35 as illustrated may simply be placed against a horizontal flat surface with the MYLAR sheeting in place, the silicone rubber material permitted to cure over a period of hours, and the MYLAR sheeting then peeled off to expose a flat face of the silicone rubber material for presentment against an upright surface as illustrated in FIG. 2.

To enhance forces of magnetic attraction $F_a$ which are provided by a structure as shown in FIG. 2, alternatively, a structure as designated at 50 may be employed wherein the display board 36 carries a magnet assembly 51 having a suitable metal, ceramic or plastic permanent magnet 53 of desired shape and configuration but contained within a cup or shell 54 of steel or other ferromagnetic material to provide in effect a pole piece. Such shell 54 confines the magnetic flux to increase the flux density of the magnetic circuit completed between the magnet 53 and material 28. For example, a shell 54 of the type shown is circular in shape but is desirably of a configuration which may be secured to sheet or display board 36, as by a layer 55 of adhesive between the rear face 56 of shell 54 and the face 57 of sheet 36 to which the magnet 53 is to be secured.

Figure 3:
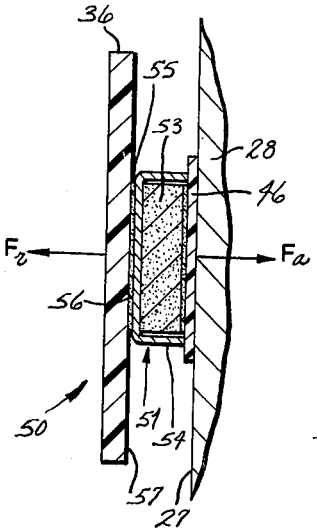

FIG. 3 is illustrative of a further aspect of the invention regarding the adherence of the elastomeric layer 46. When said layer is one of the materials selected from the group consisting of plasticized polyvinyl chloride, plasticized polyvinyl acetals, and vulcanizing silicone rubber, the intrinsic adherence of such layer is releasably adhesive in character. That is, it may be said to cling to the surface even though it can be readily pulled therefrom without leaving particles, residue or the like on the surface. The apparatus, therefore, may be releasedly adhered by the elastomeric layer 46 to surface 27 but is readily removable therefrom upon an application of a removal force $F_r$ normal to and outward from said surface. Such removal force must overcome the force $F_a$ of magnetic attraction, of course.

However, when the elastomeric layer 46 is constituted by plasticized polyvinyl acetal, and particularly polyvinyl butyral, the apparatus has a removal force $F_r$ which is substantially greater than the magnetic attraction force $F_a$. This characteristic results from a certain natural tackiness of the polyvinyl butyral material. But, even when this material is employed in the structure of the invention, the structure may readily be removed from the surface 27 to which it is secured, again without leaving significant or visible amount of the elastomer, etc. on the surface.

When the elastomeric material is either plasticized polyvinyl chloride or vulcanizing silicone rubber, the apparatus has a removal force $F_r$ which is not substantially greater than said magnetic attraction force $F_a$.

Such clinging, releasably adhesive characteristic of such preferred materials may result from van der Waals attractive forces or, may simply be the result of the absence of air between the face of the material 46 and object surface 27 resulting from the force of magnetic attraction which presses the elastomeric layer firmly against surface 27.

Figure 4:
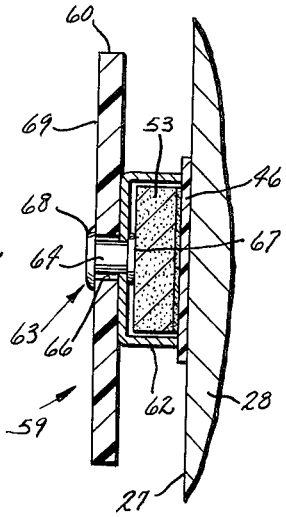

FIG. 4 is illustrative of another arrangement of a display apparatus 59, constructed in accordance with the invention. The device includes a display board or sheet 60 of the same general type as shown in FIGS. 2 and 3 and employs a magnet 53 which is, as in the embodiment of FIG. 7, surrounded by a thin shell 62 or pole piece of steel or other ferromagnetic material. Said shell 62 is secured to display board 60 by a stud 63 having a shank portion 64 which passes through an aperture 66 in display board 60 and also through a corresponding aperture in shell 62. An enlarged diameter portion or head 67 affixes the stud to magnet shell 62. Another enlarged portion or head 68 on the front surface 69 of board 60 secures the stud in relationship to board 60 and thereby affixes shell 62 of the magnet to display board 60. Such stud 63 may, for example, be a rivet or various other fastening devices. The stud may, if desired, be formed integrally with shell 62 or be welded thereto or the like so as to be secured other than as illustrated to said shell.

The construction thus illustrated in FIG. 4 obviates the use of an adhesive layer such as that indicated at 55 in FIG. 3 to secure the magnet assembly to the display board. Further, the use of an adhesive to secure the elastomeric layer 46 to magnet 53 may be avoided by the use of a vulcanizing silicone rubber, as previously described, which is permanently self-adhering when cured in situ on the magnetic structure before application to surface 27 or when said layer is of polyvinyl butyral which, when suitably heated, as by autoclaving, can be made to be substantially permanently adherent to the face of magnet 53.

Figure 5:
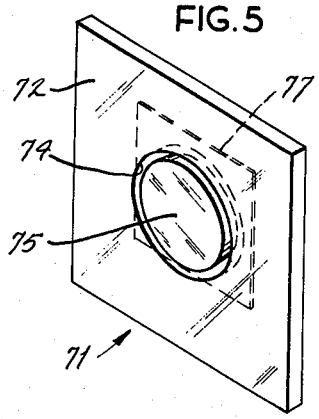
FIG. 5 is a perspective view of one embodiment of a permanent magnet assembly of the invention.

FIG. 5 illustrates a structure 71 constructed in accordance with the invention. This structure includes a board 72 for display or other purposes which is of a material such as various plastics, composition board, metals including non-magnetic, ferromagnetic or paramagnetic, wood or other materials of the type previously noted. Said board 72 is provided with a large central aperture 74 of shape to accommodate the magnet. Positioned within aperture 74 is a permanent magnet assembly 75 which is also of similar configuration to the aperture shape but has an extent which is less than that of aperture 74. The magnet assembly 75 may be simply a permanent magnet such as that illustrated at 41 in FIG. 2 or may be enclosed in a pole piece or shell 54 of the type shown in FIG. 3. In either event, the magnet assembly is adhered in a manner as disclosed above, as by the use of permanent adhesive to a layer 77 of elastomeric material described above but preferably fabric-backed plasticized polyvinyl chloride or polyvinyl butyral. Vulcanizing silicone rubbers are less preferred.

Figure 6:
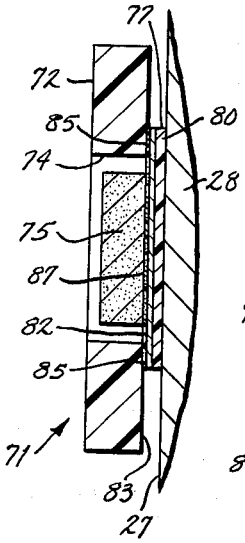
FIG. 6 is a cross section of the assembly of FIG. 5.

Thus, in FIG. 6, the display board or sheet of non-magnetic material 72 which is provided with aperture 74 is shown to have positioned in said aperture a permanent magnet 75 of the type shown in FIG. 2. The elastomeric layer 77 is shown to comprise a calendered face 80 marginal portions of which extend sheetwise out beyond the periphery of magnet 75 and overlap margins of the large aperture at the rear face 83 of board 72 which is opposed to surface 27. These overlapping marginal portions are secured by adhesive as indicated at 85 to face 83 of the display board. If a fabric-backed material is used, the fabric backing 82 of layer 77 is also adhesively secured as indicated at 87 to a face of magnet 75 which is opposed to surface 27 on the paramagnetic or ferromagnetic material 28.

While said layer 77 of elastomeric material is shown applied sheetwise to the rear face 83 of board 72 so as to lie parallel to the rear face thereof with opposed faces adhesively secured together, it may instead be secured to the board as by forming a cup or loop of the material having marginal portions secured within aperture 74 or by folding the edges of the material in upon itself and securing these free edges to the rear face 83 of the board. Alternatively, the elastomer may be extended over a large enough area to cover more than one magnetic assembly of the type shown. Another method of securing the sheet may be to fasten one or more marginal portions of the elastomer to one or more edges of the board.

As in the previous structures, the force of magnetic attraction mutually provided between magnet 79 and material 28 maintains the elastomeric material in contact with face or surface 27. However, because of the relative positioning of magnet 29 within aperture 74, the center of gravity of the structure 71 is located closer to surface 27 than in embodiments of the invention which are illustrated in FIGS. 2–4. As a result, the force of gravity upon the structure does not provide as high a bending moment or leverage about the lower point of attachment of the structure to surface 27 as in the previous embodiments and hence the structure has enhanced capability to remain magnetically secured on surface 27.

Figure 7:
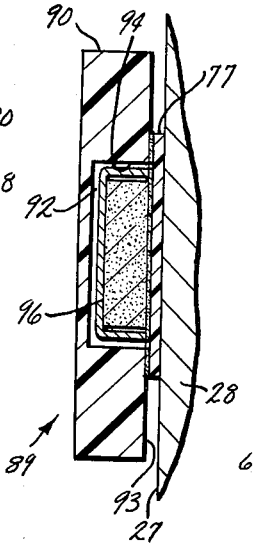
FIG. 7 is a cross section of a modification of the assembly of FIG. 5.

FIG. 7 illustrates an alternative configuration 89 of the general type shown in FIGS. 5 and 6. In apparatus 89, a board 90 for display, etc. is provided with a cavity opening to the rear face 93 of the board. This cavity is of a configuration and size so as to provide an aperture 94 at the rear face 93 of the display board, which aperture is sufficiently large to accommodate a magnet assembly 96 within cavity 92, with the magnet assembly free to move within the cavity due to the flexibility of the elastomeric layer 77.

Figure 8:
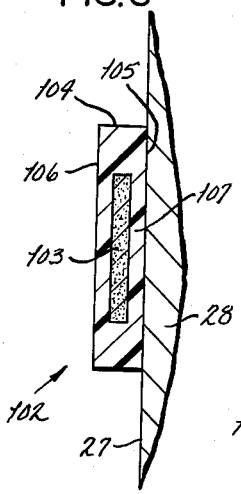
FIGS. 8 and 9 are cross sections of two alternative embedded permanent magnet arrangements which may be utilized in accordance with the invention.

The principles of the invention are not limited to the use of the preferred elastomeric materials only between the magnet and the surface to which apparatus in the invention is to be magnetically secured. FIG. 8 illustrates a structure 102 in accordance with the invention wherein a permanent magnet 103 is embedded, as by molding or the like, within a sheet or layer 104 of one of the above described elastomeric materials. The sheet of elastomeric material has its rear face 105 applied to surface 27, the front face 106 thereof being utilizable for presentation of display materials or for securement as by means of adhesive, fasteners, or the like to further structure, such as a larger display board, for example. Again, the shape of said structure 102 in plan is not of particular significance and may be circular, rectangular, or other shapes or configurations appropriate for the use intended. However, in keeping with the principles described above, the thickness of a layer or region 107 between magnet 103 and surface 27 is relatively small so as to maintain said material in contact with surface 27 with a relatively high force of magnetic attraction. Thickness ranges appropriate for the materials described above are also appropriate for the thickness of region 107.

Figure 9:
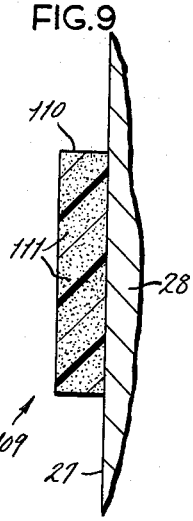

FIG. 9 illustrates yet another construction 109 having a layer 110 of said elastomeric material but with oriented magnetic particles 111 dispersed therein to provide a homogeneous construction capable of developing substantial force of magnetic attraction but where elastomeric material of the types previously described (i.e., plasticized polyvinyl chloride, polyvinyl acetals and vulcanizing silicone rubber) provide the high intrinsic lateral adherence to surface 27 to maintain the construction in place notwithstanding relatively high forces tending to displace the construction. The magnetic particles 111 uniformly distributed throught the elastomeric material 110 may comprise various ferromagnetic materials such as iron, steel, barium ferrites, ferrous alloys, or various other special alloys (such as aluminum-nickel-cobalt) utilized for permanent magnet construction. To create a permanent magnet, a mixture of the elastomer and such particles 111 may be cured while the structure is maintained in a high magnetic field. Upon curing, a high degree of magnetization is retained. However, notwithstanding the dispersal of the magnetic particles throught the layer 110, the force of magnetic attraction maintains the elastomeric material in contact with the surface 27 at all times and the high lateral intrinsic adhesion develops between said material 110 and surface 27 maintains the construction securely in place.

Figure 10:
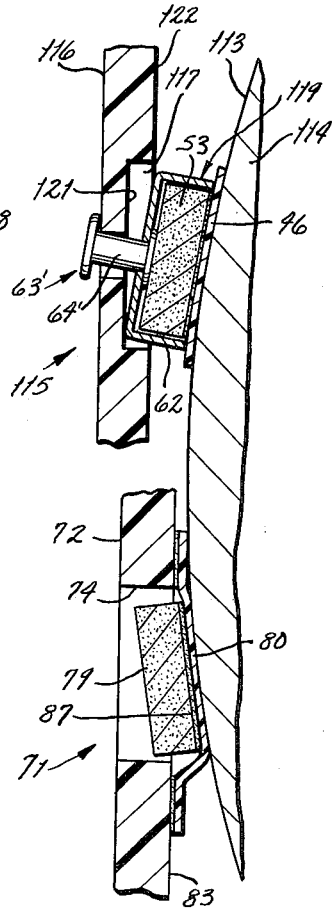
FIG. 10 is a cross section illustrating conformal adaptance to a surface of magnet assemblies of the type shown in FIGS. 4 and 6.

FIG. 10 illustrates the use of constructions as described above for securement to a surface 113 which is not flat but, rather, has a curvature which is typical of many appliances, such as some kinds of refrigerators, which typically are of sheet steel 114. Indicated generally at 115 is a construction having a thin sheet or board 116 having a cavity 117 therein. A permanent magnet 53 of the type previously described which is surrounded by a steel or other ferromagnetic shell 62 is secured to said display board 116 by means of a stud 63' having an elongated shank 64' so as to permit movement of the magnet assembly, the latter being designated in its entirety generally at 119, relative to the display board 116 so as to accommodate placement of the display board in such fashion that the axis of stud 63' may accommodatingly angle relative to the display board but be normal to surface 113 so as to enhance adherence of the elastomeric layer 46 to surface 113.

In a display structure, etc. incorporating two such assemblies 119, a display board or the like having a spaced pair of such assemblies may readily conform to the curvature of surface 113 while maintaining the display surface 116 securely in place on said surface. It may also be noted that display board 116 is provided with a cavity 121 opening to the rear face 122 thereof so as to permit placement of the center of gravity of the display board closer to the surface 113 than would otherwise be the case if constructed in accordance with FIG. 4.

FIG. 10 also illustrates the application to such curved surface 113 of a magnet construction of the type described and shown in connection with FIG. 6. However, the construction of FIG. 7 is also accommodative in like fashion. Such embodiment is especially accommodative of the curvature inasmuch as the portions of the layer material 80 which bridge between magnet 79 and the rear face 83 of the display board provide for movement of magnet 79 within cavity 75 relative to the plane of display board 72 while retaining the advantages of such construction in positioning of the center of gravity of the structure close to the surface 113.

Figure 11:
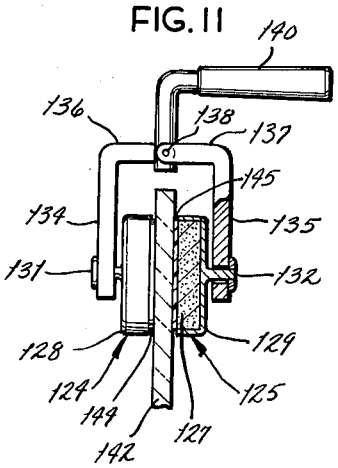
FIG. 11 is a side view, partly in cross section, of the use of concepts of the present invention in a structure for supporting an object having relatively low relative magnetic permeability.

FIG. 11 is illustrative of use of magnetic securement structures of the type previously described, such as that shown in FIG. 4. The drawing illustrates the provision of two magnetic assemblies 124, 125 which are each of identical construction except that the magnets of each such structure are of reversed magnetic polarity so as to provide for a mutual attraction therebetween, only one mass 127 of magnetic material of such structure being illustrated. These magnetic structures each have a metal shell or pole piece respectively designated at 128,129 from which extends a respective stud 131,132. A structure or mass of ferromagnetic or paramagnetic material of appropriate size and shape may be substituted for one of the magnets in such an assembly with some diminution in attractive force.

Each such magnet structure is carried by such stud at the respective end 134,135 of a pair of arms 136,137 in which are pivoted together as indicated at 138 for permitting relative movement of the magnet structures 124,125 relatively toward and away from each other. This pivot structure may have a handle extending upwardly therefrom 140 for facilitating lifting of the assembly. Shown between the magnet structures 124,125 is a sheet 142 of material, such as glass, having a relative magnetic permeability not substantially greater than about unity. Since the mass of magnetic material such as that illustrated at 127 in each of the magnet structures 124 are of ferrogmagnetic nature, they provide for a mutual magnetic attraction, if polarized as indicated above, so as to force the magnetic structures toward each other with said sheet of material 142, such as glass, positioned therebetween. Each said magnetic structures 124,125 has a respective layer 144,145 carried by it for being maintained in contact with said sheet of glass or other material 142. Such elastomeric layers are each of the materials as above described having high intrinsic lateral adherence to the surface of material 142.

The surface of the elastomeric material that is applied to surface 27 of ferromagnetic, paramagnetic or magnetic material 28 to provide easily releasable high lateral force resistant contact is capable of being applied and released numerous times without significant deterioration from contact with dirt and particulate matter and without being tacky. Such substances as dirt and particulate matter can reduce the high lateral force resistance temporarily, but surfaces of all of the elastomeric materials can be washed off with detergent and water without adversely affecting the releasability or the high lateral force resistance.

It is possible to force particles such as talcum powder into the surface of each of these elastomers. Calendered polyvinyl chloride is most resistant to retaining such particulate matter pressed into it. Polyvinyl butyral and vulcanizing silicone rubber are moderately resistant to particles, but less so than polyvinyl chloride. Polyvinyl butyral is more resistant than vulcanizing silicone rubber to have particles forced into it.

Adhesive substances that are used for applying some magnetic devices are not easily releasable and easily and non-reversibly lose their adhesiveness permanently by contact with dirt and particulate matter.

Many adhesive materials including those that can be stripped off and reapplied a number of times, can damage some surfaces, may cause flaking of surfaces, may leave residue on surfaces, and can lose their adhesiveness non-reversibly by contact with dirt and particulate matter.

None of these difficulties with other adhesive substances apply significantly to the releasably adhesive materials of the invention just disclosed, such as calendered polyvinyl chloride, polyvinyl butyral, and vulcanizing silicone rubber which are preferred elastomers. However, other releasably adhesive materials of a generically elastomic character may be used in accordance with the invention.

The following examples are illustrative of the invention:

EXAMPLE 1

| Category | Description |
|---|---|
| I | Apertured metal shell (pole piece) over apertured circular plastic magnet; magnet dia. 1.125 in. (2.86 cm), shell dia. 1.25 in. (3.18 cm), magnet face area 0.678 in$^2$ (4.37 cm$^2$). |
| II | Apertured metal shell (pole piece) over apertured ceramic magnet; magnet dia. 1.06 in. (2.69 cm), shell dia. 1.2 in. (3.05 cm), magnet face area 0.604 in$^2$ (3.87 cm$^2$). |
| III | Round ceramic magnet of 1.25 in. (31.8 mm) diameter having apertured center; magnet face area of 0.837 in.$^2$ (5.41 cm$^2$) |
| IV | Rectangular ceramic magnet; apertured center; magnet face of 1 × 0.75 in. (2.54 × 1.9 cm) and area of 0.75 in.$^2$ (4.82 cm$^2$) |
| V | Rectangular ceramic magnet having self-adhered elastomeric layer coating of vlucanizing silicone rubber; apertured center; magnet face of 1 × 0.75 in. (2.54 × 1.9 cm) and rea of 0.75 in.$^2$ (4.82 cm$^2$) |
| VI | Polymer-based (rubber) magnetic sheet material having imbedded barium ferrites; magnet face of 1 × 1 in. (2.54 × 2.54 cm) and area of 1 in.$^2$ (6.46 cm$^2$) |

Comparative testing of such magnets and structures incorporating the same in accordance with the invention was carried out by measuring hang forces and magnetic attraction forces of magnets of the above-noted categories where such magnet was not provided with an elastomeric layer versus those which did have secured thereto an elastomeric layer. All magnets or magnet structures were applied to a smooth vertical baked enamel surface of sheet steel.

Two types of hang force measurements were taken. A hang force $F_{x1}$ was measured by using a test jig comprising a small plastic fixture weighing about 1 oz. or less which is fitted into a central aperture in the case of categories IV and V at the back of the magnet relative to said enameled surface, or at the back of the shell, in the case of categories I, II and III, or adhered to the back of the sheet material in the case of category VI. Each of the magnets or magnet assemblies of categories I through V was of approximately 3/16 in. thickness. The magnetic sheet material of category VI was 30 mils and 60 mils thick. A measured force was then applied downward therefrom tangential to said surface with the force acting through the test jig at a distance estimated at 0.25 in. from said surface. A second hang force $F_x^2$ was measured by using a test jig comprising an elongated plastic strip of about 2 oz. or less in weight and dimension of about 6 in. length and 0.125 in. thick and width sufficient for accommodating in an aperture at one end of the strip the magnet under test so as to apply force to said magnet tangential to the enameled surface of contact with the periphery thereof (as illustrated in FIG. 1) at a distance of approximately 0.125 in. or slightly less or more, but not greater than about 0.25 in., from said enameled surface. The strip was pulled downward from the opposite end by a measured force.

In the case of category VI magnets, the thinness and lack of aperture therein precluded use of the above techniques. Hence, such magnets were adhesively secured to a 10 in. long strip, to which hang force was applied, at a distance from said enameled surface estimated to be about 0.25 in.

For each magnet or magnet structure for which a magnetic attraction force $F_a$ measured, measurement was made by pulling normally outward relative to the enameled surface.

The following table summarizes the results of such testing. In the table, the notation PPVC signifies fabric-backed calendered plasticized polyvinyl chloride of the type sold under the trade designation "TOLEX PATENEL 30219". VSR signifies one part vulcanizing silicone rubber of the type sold under the trademark "DOW CORNING ® SILICONE RUBBER BATHTUB CAULK" as a silicone rubber sealant. In the table, PPVC signified fabric-backed calendered plasticized polyvinyl chloride, VSR signifies vulcanizing silicone rubber, and elastomer surface roughening was effected by application of alcohol.

| Magnet category; run designation | Magnet condition; presence (Y) or not (N) and nature of elastomeric lazer | Approximate force (pounds) $F_a$ | $F_{x1}$ | $F_{x2}$ | Maximum $F_x/F_a$ |
|---|---|---|---|---|---|
| IA | N-filed flush | 2.84 | 0.7 | — | 0.25 |
| | Y-13 mil clear PPVC | 0.44 | .44 | 2–3 | 4.5–6.8 |
| IB | N-bare | 1.6–1.8 | 0.4 | — | 0.25–.22 |
| | Y-22 mil white PPVC | 0.44 | 0.6 | 2.5 | 5.68 |
| IC | N-bare | 1.3 | 0.4 | — | 0.31 |
| | Y-10–25 mil VSR | 0.8 | 1.1 | 1–2 | 1.2–2.5 |
| ID | N-bare | 1.3 | 0.4 | — | 0.31 |
| | Y-24 mil black PPVC | 0.4 | 0.6 | 1–2 | 2.5–5 |
| IE | N-bare | 1.3 | 0.4 | — | 0.31 |
| | Y-24 mil black PPVC with roughened surface | 0.4 | 0.3–0.5 | — | .7–1.2 |
| IIA | N-bare | 4.0 | 0.8 | — | 0.2 |
| | Y-24 mil black PPVC | 0.88 | 1.7 | 4.7 | 5.3 |
| IIB | N-bare | 3.9 | 0.7 | — | 0.18 |
| | Y-22 mil white PPVC | 0.84 | 1.5 | 3.7–5 | 4.4–6 |
| IIIA | N-bare | 0.6 | 0.1 | — | 0.17 |
| | Y-24 mil black PPVC | 0.4 | 0.7 | 2 | 5 |
| IIIB | N-bare | 0.6 | 0.1 | — | 0.17 |
| | Y-22 mil white PPVC | 0.4 | 0.4 | 1 | 2.5 |
| IIIC | N-bare | 0.6 | 0.1 | — | 0.17 |
| | Y-22 mil white PPVC | 0.4 | — | 1 | 2.5 |
| IIID | Y-24 mil black PPVC | 0.4 | — | 1 | 2.5 |
| | Y-24 mil black PPVC with roughened surface | 0.4 | — | 0.2 | 0.5 |
| IIIE | N-bare | 0.6 | — | 0.1 | 0.17 |
| | Y-10 mil VSR | 0.4 | — | 2.5 | 4.2 |
| IIIF | N-bare | 0.6 | — | 0.1 | 0.17 |
| | Y-8 mil clear vinyl | 0.4 | — | 2.5 | 4.2 |
| IIIG | N-bare | 0.6 | — | 0.1 | 0.17 |
| | Y-8 mil clear vinyl | 0.4 | — | 2.5 | 4.2 |
| IIIH | N-bare | 0.6 | — | 0.1 | 0.17 |
| | Y-24 mil black PPVC | 0.4 | — | 2 | 3.3 |
| IIIJ | N-bare | 0.6 | — | 0.1 | 0.17 |
| | Y-8 mil clear vinyl with roughened surface | 0.4 | — | 1 | 1.7 |
| IVA | N-bare | 0.5 | 0.2 | — | 0.4 |
| | Y-22 mil white PPVC | — | 0.4 | nil | (0.8)* |
| IVB | N-bare | 0.5 | 0.15 | — | 0.3 |
| | Y-24 mil black PPVC | — | 0.6 | 1 | (2.0)* |
| VA | N-bare | 0.7 | 0.6 | — | 0.86 |
| | Y-10–25 mil VSR | — | — | 1 | (1.4)* |
| VB | N-bare | 0.5 | 0.4 | — | 0.8 |
| | Y-10–25 mil VSR | — | — | 1 | (2.0)* |
| VIA | N-two 1 in$^2$ 60 mil magnetic sheet material cemented to 10 in. plastic strip | 1.0 | — | 1.3 | 1.3 |
| VIB | N-same as VIA but 30 mil | 1.0 | — | 0.9 | 0.9 |
| VIC | N-one 1 in$^2$ 60 mil magentic sheet material | 0.5 | — | 0.7 | 0.7 |

*In the absence of values of data for $F_a$ where the elastomeric layer was present, the ratio $F_x/F_a$ is shown based upon the value of $F_a$ taken where the elastomeric layer was not present. Since $F_a$ diminishes with gap spacing resulting from the presence of the elastomeric layer, these ratios are probably understated.

EXAMPLE 2

This example illustrates the use of plasticized polyvinyl butyral (PVB) elastomeric layers when employed with magnets of category III described in Example 1 in accordance with the invention. The following table summarizes the units when measured in accordance with the procedures set forth in Example 1, again utilizing the same enameled surface.

| Run designation | Nature and conditions of test and PVB layer | Approximate force $F_{x2}$ (pounds) |
|---|---|---|
| A | Approx. 30 mil thick layer autoclaved to bond to face of magnet | 2–3 |
| B | Same conditins as A but approx. 15 mil thickness | 2 |
| C | Approx. 15 mil thick layer bonded to face of magnet but PVB exposed face treated before application to enameled surface by applying isopropanol; tested after dried | 2–3 |
| D | Same as C, but tested after structure being permitted to remain on enameled surface overnight | 5 |
| E | Same conditions as C but approx. 30 mil thick layer | 2–3 |
| F | Same condition as D but approx. 30 mil thick layer | 5 |
| G | Same condition as C; sustained load of 4 min. duration | 4 |
| H | Same condition as D | 5+ |
| J | Same condition as E, but load applied only after 3 min. load duration of 60 sec. sustained | 3 |
| K | Same conditions as E, but load applied only after 5 min. sustained load duration of 5 min. | 4 |
| L | Same conditions as K, but sustained load duration for for 2 min. | 4 |
| M | Same conditions as E, but load applied only after 30 min., sustained load duration for 1 hour | 4 |

Each magnet, in the absence of the PVB elastomeric layer, provided a magnetic pull (attraction) force to said surface of $F_a$=0.6 lb. and exhibited hang force $F_{x1}$ of approximately 0.1 lb. The measurement of attraction force $F_a$ when the PVB elastomeric layer was present varied with time, ranging from very approximately 0.5 lb., if pulled continuously away from the surface over a sustained period of 10–30 min., up to approximately 4–5 lb. if pulled for a very short time.

EXAMPLE 3

This example illustrates the lateral surface adherent capabilities of a structure constructed as depicted in FIG. 4, there designated 59. A rectangular sheet 60 having sheetwise dimensions of 178 mm×178 mm and thickness of 2 mm was riveted (as represented by stud 63) to the shell 62 of a magnet assembly of category II described in Example 1, the face of the magnet 53 having cemented thereto an elastomeric layer of white plasticized polyvinyl chloride sheet material of the type described in Example 1, and of circular shape and a diameter of about 38 mm. When tested, said structure was formed to exhibit a magnetic attraction force $F_a$ of approximately 0.8–0.9 lb., a hang force $F_{x1}$ of approximately 0.9–1.0 lb., and of approximaly 1.0 lb., when applied to a corner of said sheet 60.

EXAMPLE 4

This example illustrates the lateral surface adherent capabilities of a structure constructed as depicted in FIGS. 5 and 6, there designated 71, but wherein the magnet assembly employed was of category II described in Example 1 having a magnet surrounded by a metal shell or pole piece substantially of the type shown in FIG. 7. A rectangular sheet 72 having sheetwise dimensions of 178 mm×178 mm and a thickness of 2 mm. The elastomeric layer 77 was of white plasticized polyvinyl chloride sheet material of the type described in Example 1, and of a rectangular shape approximately 70 mm ×76 mm, having its margins cemented to the face 83 of sheet 72. When tested, said structure was found to exhibit a magnetic attraction force $F_a$ of approximately 1.0 lb., a hang force $F_{x1}$ of approximately 1.4–2.0 lb., and of approximately 2.2 lb. when applied to a corner of said sheet 72.

The foregoing examples indicate the synergistic nature of the invention by demonstrating the superior capability of apparatus of the invention to support weights far in excess of that provided by a magnet having a bare face applied to the vertical, smooth enameled surface of sheet steel employed in the examples, where said bare-faced magnet is of equal strength.

In general, structures of the invention demonstrates a capability of remaining secured to a smooth surface, without lateral slippage thereon, in resistance to lateral force applied to the structure proximate to and tangent to the surface until the lateral force reaches a maximum value substantially greater than 1.3 times the magnetic attraction force normal to the surface, and typically within the range of greater than about 2 times up to about 8 times the magnetic attraction force of the structure.

Generally speaking, bare magnets of the categories described will slip with lateral displacement forces which typically are as little as 0.17 and more rarely about 0.2–0.4 of the magnetic attraction force available of conventional magnets, only polymer-based (rubber) magnetic sheet material of a commercially available type such as sold by the 3M Company is found to exhibit a resistance, before shipping, to lateral displacement force which exceeds the magnetic attraction force available, and typically about 1.3 times the magnetic attraction force.

Considered in another way, magnetic securement structures of the invention provide hang capabilities (as measured by maximum lateral displacement force before slippage) which typically are many times the hang capabilities of the magnets used in such structures when said magnets are not provided with elastomeric layer material but are instead applied with a bare face to a smooth surface. Generally the maximum hang forces of such structures are from about 2 to about 50 times the bare magnet hang force ("hang-bare"). When utilizing plasticized polyvinyl chloride or vulcanizing silicone rubbers, such enhanced-hang to hang-bare ratios may be expected to be within the range of from about 2–20. When utilizing suitable plasticized polyvinyl acetals, and particularly plasticized polyvinyl butyral, such enhanced-hang to hang-bare ratios may typically be as high as 20–50. When hang capabilities of structures of the invention are compared with the magnetic attraction force available from bare magnets, which magnets are to be employed in such structures, one may evaluate structures of the invention by comparing the enhanced-hang force to the bare magnet attractive force, or "pull-bare". When so evaluated, magnet structures of the invention are found to provide enhanced-hang to pull-bare ratios of typically from about 1 to about 4 when employing plasticized polyvinyl chloride or vulcanizing silicone rubber, and typically from about 3.8 to about 8 when employing plasticized polyvinyl butyral.

Structures of the invention are thus formed to show truly remarkable adhesion to various smooth surface including polished ferrous metals, and various surfaces which, while generally smooth, are embossed (textured) or given other surface treatment for use on appliances. The new magnetic securement apparatus adheres well to all such typically encountered surfaces, including painted, enameled, glassy, or otherwise coated steel and other metal appliances having the requisite ferromagnetic or paramagnetic characteristics for facilitating adequate magnetic attraction forces by the new devices. Particularly the adhere well to the upright surfaces of appliances, cabinets and the like having bare or coated surfaces of steel or stainless sheet material. Moreover, due to the compliant nature of the preferred elastomeric layer materials employed, the structures will adhere even to smooth surfaces such as those which are painted or baked enamel having an "orange peel" texture sometimes exhibited by appliances.

While structures of the invention provide magnetic securement capabilities which represent a true advance in the art, the augmentation of hang force, i.e., resistance to lateral movement (slippage) across the surfaces to which the structures are magnetically secured, is not well understood. However, without limitation to any specific theories, it is thought that the static friction, i.e., lateral adhesion enhancement of the invention derives primarily from polar group attraction between molecules of the elastomeric layer material and the surface against which it is maintained by continuous restorative pressure of magnetic forces so long as such forces are present. The supple or compliant nature of the elastomers may allow mobility of the polar groups so that they will align to produce an intrinsic adhesion to the surface to which applied.

It is found that elastomeric layer materials of the type employed exhibit even greater intrinsic lateral adhesion to the surface to which applied when left in contact with the surface for a period of time. This possibly may be due to slow orientation of the mobile polar groups within the polymeric elastomer. Such effect is particularly observable when utilizing plasticized polyvinyl butyral.

The laterally adhesive nature of the elastomeric materials employed in the invention are demonstrated by placing only a layer of one of such materials against a glass sheet surface and then artificially applying a force to press the material against the glass in a matter roughly similar to the effect of magnetic forces on the layer. When viewed from the opposite side of the sheet, a distinctly pronounced "wetting" appearance is seen, even though no actual wetting or other deposit, filming or the like is perceptible upon subsequent removal of the elastomer from the glass sheet.

Referring now to FIGS. 12–16, a display board, designated generally 148, is adapted for magnetic securement to an object having a smooth surface 27 and of ferromagnetic or paramagnetic material 28, as previously described, such as the front of a refrigerator. Display board 148 is adapted for remaining magnetically secured to said surface 27 in lateral displacement resistant relationship thereto, i.e., not prone to slip on or fall off said surface.

The new display board comprises a thin, flat sheet 150 of rectangular shape and comprised of self-supporting material such as resilient, flexible synthetic resin material (e.g., "PLEXIGLAS"), wood, composition board, aluminum or various other materials of adequate strength for providing a support structure. Sheetwise dimensions of sheet 150 typically may be several inches to a foot or even two feet or more along each side, with preferred thickness as little as 1/16 in. up to ¼ in. or more, dependent upon the strength and density of the material selected.

Shown carried on a front face or display surface 151 of sheet 150 is a pad 153 of paper sheets such as shopping lists, memos or the like. Such pad 153 may be relatively thick and heavy and is merely illustrative of various items of like nature which can be effectively, securely and safely carried by the new display board. Said pad 153 is supported in position on face 151 by a clip or channel-shaped retainer 154 which extends transversely across the face 151 of sheet adjacent the top edge 155 thereof, said clip or retainer 154 being secured to sheet 150 by rivets 156 or appropriate adhesive.

Preferably, though not necessarily, the lower edge 158 of the pad 153 may be secured and supported by a suitable projection such as a pair of posts 160,161 each having a finger 163,164 which extends over the lower margin of pad 153 for orderly retention of paper sheets of the pad. Posts 160,161 may extend into apertures of sheet 150 or be secured thereto in other suitable ways. Alternately a strip of plastic, metal, etc. may extend across the face adjacent the lower edge 166 of the sheet and have a lip, if desired, to retain lower edges of the paper sheets.

Indicated at 167 is a writing pen assembly having a pen 168 such as of the ball point type and a cap 169 which is secured, as by rivets 171 or other method of securement, to face 151 adjacent the right edge 172 of sheet 150 (the left edge being designated 172'), with the cap oriented at the lower end of the assembly for convenience in withdrawing and reinserting pen 168 in cap 169. The end of pen 169 remote from cap 169 is secured by a bead-type chain 174 or other flexible ligament of suitable nature having its remote end appropriately secured as by a rivet 175. Hence, the pen is conveniently presented upon the front face 151 of sheet 150 for use in writing upon a front sheet of pad 153.

The display board employs magnetic securement structures of the type described in connection with FIGS. 6–7, although studmounted structures of the type generally as described in connection with FIGS. 4 and 10 may instead be used.

Referring to FIG. 14, which is a rear view of the display board, two such magnetic securement structures 177,178 are provided, these being presented at the rear face 180 of sheet 150 and spaced symmetrically on opposite sides of the vertical center-line and positioned in a line parallel to and relatively near the upper edge 155 of the sheet.

Each of said magnetic structures 177,178 is of identical configuration, as shown in cross-section in FIG. 15, has magnet assembly 181 including a steel or other ferromagnetic shell 182 and a permanent magnet 183 of circular shape fitted within the shell, the shell acting as a pole piece. A face 185 of the magnet is adhesively secured to a layer 186 of elastomeric material of the types providing high intrinsic lateral adherence to a surface, e.g., surface 27 of ferromagnetic or paramagnetic material 28, all as previously described.

Most preferably, such layer of elastomeric material is a fabric-backed calendered plasticized polyvinyl chloride sheet material as described above in connection with FIGS. 5–7, with the fabric backing secured to the face 185 of the magnet by a layer 188 of suitable adhesive and with the calendered face being presented for contacting surface 27.

Each shell 182 of the magnet assembly is shown for purposes of illustration as being of a circular shape and is positioned within a respective conforming aperture 190 of sheet 150 having a slightly larger size than the shell for permitting movement of the magnet assembly thereof. The elastomeric layer of each of structures 177,178 is, for example, rectangular shape and has marginal portions 192 extending sheetwise outwardly beyond the periphery of the magnet and its shell, as well as beyond the periphery of the aperture 190, such marginal portions being secured to rear face 180 of the sheet by a layer of adhesive as indicated at 193. Accordingly, each magnet structure is supported by sheet 150 via the elastomeric layer with the resilience and flexibility of the layer permitting movement of the magnet structure relative to the aperture in the sheet for conformal adherence to surface 27, as shown in FIG. 10, even when said surface is slightly curved. Importantly, the elastomeric layer 186 lies parallel to and essentially adjacent to the rear face 180, the securement face being spaced rearwardly from face 180 by only the thickness of the layer material. Thus a "hang close" configuration is attained.

FIG. 13 illustrates magnetic securement of the new display board 148 to upright surface 27 by means of the new magnetic structures or assemblies.

Apertures 194 are provided at each corner of sheet 150 for optional securement of the display board to a wood or other surface providing no magnetic attraction.

Principles of the invention are not confined to securing the display board, and a further feature incorporating the inventive principles is a clip assembly 195 magnetically secured to the front of the display board. Referring to FIG. 16, the clip assembly has a conventional spring clip 197 for holding one of its actuating fingers 198 secured distally to a magnet structure 200 of the invention. Said structure has a permanent magnet 201 of circular or other shape surrounded by a metal shell or pole piece 203, said actuating finger 198 being riveted thereto as indicated at 204.

Secured to the rear face of magnet 201, as by cementing or self-adhering action, is a layer of elastomeric material 206 of the character described above. Hence the clip assembly 195 is itself adapted for being magnetically secured to surface 27 or other nearby appliance surface, for example, in lateral movement-resistant relationship. However, the clip assembly may be retained conveniently on the front face 151 of the display board.

For this purpose, a small area of ferrous metal may be carried on front face 151. Or preferably, as shown, secured to sheet 150 by a rivet 207 or adhesive adjacent its lower edge 166 is another permanent magnet 208 polarized for providing mutual magnetic attraction with permanent magnet 201. Adhesively secured to the face of the latter is a layer 210 of elastomeric material which preferably is of the same kind as layer 206. Hence, the clip assembly is magnetically secured to the exposed face of layer 210 and held there with strong magnetic forces of attraction with a high degree of resistance to lateral displacement.

Regardless of which type of magnetic assembly disclosed is employed in the new display board, hang force is best developed and maintained by applying moderate thumb pressure momentarily directly over the magnetic assemblies, such as 177,178 when the display board is placed in position on a surface, e.g., surface 27 of ferromagnetic or paramagnetic material 28, all as previously described. In a display of the invention where two or more magnetic assemblies such as 177,178 are used, one of them should be centered about 1½ to 4 in. (preferably about 2-½ in.) from the top edge 155, and about 1-½ to 3 in. (preferably about 2 in.) from the right edge 172. Another should be centered at corresponding distances from the top edge and left edge 172', respectively, so as to facilitate thumb pressure over these magnetic devices when the display board is held upright in front of the person applying it, so that the fingers of each hand are curled respectively around each edge 172 and 172' and the thumbs are over the regions of the magnetic assemblies 177,178. The display board is easily and naturally held with the front of the fingers against surface 180, the backs of the fingers against surface 27, and the thumbs on the front of the display board. As the fingers release the board, the thumbs can easily and naturally apply the desired pressure over magnetic assemblies 177,178, seating them and fixing the board firmly to the surface 27 of ferromagnetic or paramagnetic material 28, all as previously described.

Where there will be no significant interference with display function, marks can be printed on the memo pads, shopping lists, etc., indicating the advisable points at which to apply pressure for whatever number of magnetic assemblies are used.

The new display board demonstrates many advantages. It is extremely and tenaciously adherent when applied to the upright enameled or other painted, plated or coated surfaces of sheet steel employed in appliances such as refrigerators, providing such considerable resistance to lateral displacement on such surface that large pads of sheets are readily carried without danger of the display board's slipping or becoming dislodged from the surface. The slight movement of the magnet assemblies readily facilitates conformance and good surface contact of the elastomeric layer material with the surface despite slight curvature or other surface irregularities.

The resilient and conformal nature of the preferred elastomeric materials permits close and tight adherence to such surfaces with minimum spacing between the permanent magnet and surface to which the structure is secured. The elastomeric material prevents marring or scuffing of the surface.

Additionally, the advantageous placement of the center of gravity of the display board structure close to the surface, with its rear face 180 essentially almost touching the attractive surface 27, reduces undesirable force moments, i.e., leverage exerted by gravity.

These various features are such as to provide a synergistic result amounting to substantial advance in the art.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or show in the accompanying drawings shall be interpreted as illustrative rather than limiting.

Having described my invention, what I claim and desire to obtain by Letters Patent is:

1. Display apparatus for magnetic securement to a ferromagnetic or paramagnetic object having a smooth surface in lateral displacement resistive relationship thereto, said apparatus comprising a support structure constituted by a sheet of self-supporting material, a display surface presented at the front face of said sheet, magnet means carried at a rear face of said sheet and positioned for developing a force of magnetic attraction to said object with said display surface presented for display purposes, said magnet means comprising a plurality of permanent magnets and means supporting said permanent magnets while permitting movement of said permanent magnets relative to said sheet to permit conformal adapsance and adherence of said permanent magnets to said smooth surface regardless of surface curvature or irregularity, said apparatus including a layer of elastomeric material associated with said magnet means and adapted for being interposed between said magnet means and said object surface with an area of said material maintained in contact with said surface by force of magnetic attraction of said magnet, said material being selected from the group consisting of plasticized polyvinyl chloride, plasticized polyvinyl acetals, and vulcanizing silicone rubber, said area of material magnetically maintained in contact with said object surface developing high intrinsic lateral adherence to said object surface for preventing said apparatus from moving laterally across said surface in response to high forces tending to laterally displace said apparatus.

2. Display apparatus according to claim 1 and further characterized by said magnet means having a face oriented toward said object surface, said area of material being at least as great as the area of said magnet face.

3. Display apparatus according to claim 2 and further characterized by said area of material magnetically maintained in contact with said object surface preventing said apparatus from being laterally displaced in resistance to lateral forces at least greater than about 1.3 times said force of magnetic attraction.

4. Display apparatus according to claim 2 and further characterized by said area of material magnetically maintained in contact with said object surface preventing said apparatus from being laterally displaced in resistance to lateral forces at least greater than about 2–8 times said force of magnetic attraction.

5. Display apparatus according to claim 1 and further characterized by each magnet being supported by at least one respective stem extending through said aperture, said stem permitting axial movement within the respective aperture.

6. Display apparatus for magnetic securement to a ferromagnetic or paramagnetic object having a smooth surface in lateral displacement resistive relationship thereto, said apparatus comprising a support structure constituted by a sheet of self-supporting material, a display surface presented at the front face of said sheet, magnetic means carred at a rear face of said sheet and positioned for developing a force of magnetic attraction to said object with said display surface presented for display purposes, said magnetic means comprising a plurality of permanent magnets and means supporting said permanent magnets while permitting movement of said permanent magnets relative to said sheet to permit conformal adapsance and adherence of said permanent magnets to said smooth surface regardless of surface curvature or irregularity, said apparatus including a layer of elastomeric material associated with said magnetic means and adapted for being interposed between said magnetic means, said sheet of self-supporting material comprising a plurality of apertures, said magnets being located within a corresponding aperture, each magnet being supported relative to said aperture by said elastomeric material, said elastomeric material layer having a face for contacting said surface and an opposite face, each magnet being secured to said opposite face, said layer having magnetized portions extending beyond the respective magnet and secured to said sheet, and said object surface with an area of said material maintained in contact with said surface by force of magnetic attraction of said magnet, said material being selected from the group consisting of plasticized polyvinyl chloride, plasticized polyvinyl acetals, and vulcanizing silicone rubber, said area of material magnetically maintained in contact with said object surface developing high intrinsic lateral adherence to said object surface for preventing said apparatus from moving laterally across said surface in response to high forces tending to laterally displace said apparatus.

7. Display apparatus according to claim 6 and further characterized by said marginal portions being secured to the rear face of said sheet.

8. Display apparatus according to claim 7 and further characterized by said elastomeric layer material lying in a plane parallel to and adjacent the rear face of said sheet, said elastomeric layer having portions extending in sheetwise directions outward from and beyond the periphery of the respective apertures.

9. Display apparatus according to claim 6 and further characterized by each said magnet having a metal shell surrounding portions of said magnet, said magnet being secured by means of said shell, said shell being of a ferromagnetic material for constituting a magnetic pole piece for said magnet, said magnet within said shell presenting a face for contacting said elastomeric material to maintain said area of said material in contact with said surface.

10. A display board for magnetic securement to the smooth surface of an object of ferromagnetic or paramagnetic material in lateral displacement resistive relationship thereto, said display board comprising a sheet of self-supporting material having a front face for display purposes and a rear face for placement adjacent said surface, a plurality of permanent magnets, a layer of elastomeric material associated with each said magnet and adapted for having areas thereof maintained in contact with said surface by said magnets, means for supporting each of said permanent magnets relative to said rear face to permit movement of each of said magnets relative to said sheet for conformal adaptance and adherence of each of said magnets to said smooth surface, said elastomeric material being selected from the group consisting of plasticized polyvinyl chloride, plasticized polyvinyl acetals, and vulcanizing silicone rubber, said areas of material magnetically maintained in contact with said object surface developing high intrinsic lateral adherence to said object surface for preventing said display board from moving laterally across said surface in response to high forces tending to laterally displace said display board regardless of curvature or irregularity of said smooth surface relative to said sheet.

11. A display board according to claim 10 and further characterized by said means for supporting said magnets comprising a metal shell providing a magnetic pole piece surrounding portions of each said magnet, said shells being carried by said sheet by securement means permitting movement of said shell relative to said sheet, each said magnet having a magnet face oriented toward said surface not covered by said shell, said magnet face having a layer of said elastomeric material secured adjacent thereto.

12. A display board according to claim 10 and further characterized by said sheet being provided with a plurality of apertures, said magnets being retained in respective ones of said apertures by said supporting means with each said magnet having a magnet face substantially coplanar with the rear face of said sheet, said elastomeric material being parallel to and adjacent said rear face.

13. A display board according to claim 6 and further characterized by said securements being provided by areas of said marginal portions which are adhesively secured to said rear face.

14. A display board according to claim 6 and further characterized by a metal shell surrounding portions of each said magnet other than said magnet face, each said shell being fitted within one of said apertures for movement laterally within the respective aperture, each said shell providing a magnetic pole piece.

15. A display board according to claim 10 and further characterized by means carried on said front face for supporting a pad of paper sheets or the like for presentment upon said front face.

16. A display board according to claim 15 and further characterized by a writing instrument and means affixing said writing instrument to said display board for writing upon said pad.

17. A display board according to claim 16 and further characterized by the last said means comprising a ligament interengaging said display board and said writing instrument.

18. A display board according to claim 17 and further characterized by said writing instrument having a cap, said cap being secured to said front face.

19. A display board according to claim 15 and further characterized by a clip for clipping loose leaves and the like, a magnet secured to said clip, means carried by said display board for providing a force of mutual magnet attraction to the last said magnet and a layer of elastomeric material secured to said magnet for being maintained in contact with said display board by said forces of mutual magnetic attraction, the last said layer being of an elastomeric material selected from the group consisting of plasticized polyvinyl chloride, plasticized polyvinyl acetals, and vulcanizing silicone rubber.

20. A display board according to claim 19 and further characterized by the last said means comprising a further magnet secured to said front face, and a further layer of an elastomeric material selected from the group consisting of polyvinyl chloride, plasticized polyvinyl acetals, and vulcanizing silicone rubber, said force of mutual magnetic attraction maintaining the two last said layers in contact.

21. A display board according to claim 10 and further characterized by said plurality of permanent magnets comprising individual magnets each having a magnet face presented at the rear face of said sheet, said sheet having opposite side edges, there being at least two such individual magnets each located adjacent a respective one of said side edges and spaced inward therefrom so as to center said magnet face thereof at a distance inward from the respective side edge which is from about $1\frac{1}{2}$ to about 3 in. whereby thumb pressure exerted on the front face of said sheet while holding said side edges with fingers of one's hands curled around the side edges will apply pressure to said magnet faces for fixing said display board to said surface.

22. A display board according to claim 21 and further characterized by said display board being of substantially rectangular shape having a top edge extending between said side edges to form upper corners, said two magnets each being spaced downward from said top edge so as to center each said magnet face below said top edge by a distance of from about $1\frac{1}{2}$ to about 4 in., whereby thumb pressure exerted on the front face of said sheet while holding said sheet with fingers of one's hands curled around said upper corners will apply pressure to said magnet faces.

23. A display board according to claim 22 and further characterized by said two magnets each being located to center the magnet face thereof at a distance inward from the respective side edge of about 2 in.

24. A display board according to claim 22 and further characterized by said two magnets each being located to center the magnet face thereof at a distance below said top edge of about $2\frac{1}{2}$ in.

25. A display board for magnetic securement to the smooth surface of an object of ferromagnetic or paramagnetic material in lateral displacement resistive relationship thereto, said display board comprising a sheet of self-supporting material having a front face for display purposes and a rear face for placement adjacent said surface, a plurality of permanent magnets, a layer of elastomeric material associated with each said magnet and adapted for having areas thereof maintained in contact with said surface by said magnets, means for supporting each of said permanent magnets relative to said rear face to permit movement of each of said magnets relative to said sheet for conformal adaptance and adherence of each of said magnets to said smooth surface, said magnets each having a magnetic face secured to said elastomeric material for movement of said magnets within said apertures, said elastomeric material having marginal portions extending in sheet-wise directions beyond the periphery of said aperture, said supporting means being instituted by securements of said marginal portions to said rear face, said elastomeric material being selected from the group consisting of plasticized polyvinyl chloride, plasticized polyvinyl acetals, and vulcanizing silicone rubber, said areas of material magnetically maintained in contact with said object surface developing high intrinsic lateral adherence to said object surface for preventing said display board from moving laterally across said surface in response to high forces tending to laterally displace said display board regardless of curvature or irregularity of said smooth surface relative to said sheet.

* * * * *